United States Patent [19]

Kilts et al.

[11] 4,317,317

[45] Mar. 2, 1982

[54] LIQUID STORAGE TANK

[75] Inventors: Harold J. Kilts; Laurence J. Swaziek, both of Middleton, Wis.

[73] Assignee: Chromalloy American Corporation, New York, N.Y.

[21] Appl. No.: 125,280

[22] Filed: Feb. 27, 1980

[51] Int. Cl.[3] ..... E04H 12/12

[52] U.S. Cl. ..... 52/224

[58] Field of Search ..... 52/224, 245, 223 R

[56] References Cited

U.S. PATENT DOCUMENTS

| | | | |
|---|---|---|---|
| 3,233,376 | 2/1966 | Naillon et al. | 52/224 X |
| 3,568,379 | 3/1971 | Johnsson et al. | 52/224 X |
| 3,568,385 | 3/1971 | Cruset et al. | 52/224 |
| 3,605,362 | 9/1971 | Sweeney | 52/224 |
| 3,965,630 | 6/1976 | Roberts | 52/224 |
| 4,015,383 | 4/1977 | Crowley | 52/224 |
| 4,069,642 | 1/1978 | Hendriks | 52/224 |
| 4,075,801 | 2/1978 | Alper et al. | 52/224 X |

*Primary Examiner*—J. Karl Bell

*Attorney, Agent, or Firm*—Wegner, Stellman, McCord, Wood & Dalton

[57] ABSTRACT

A liquid storage tank of the type which has a base, an annular concrete sidewall seated on the base and free to shift laterally thereon as it shrinks and expands, and a multiplicity of horizontal tension hoops embracing the sidewall is provided with a multiplicity of tension rods which are anchored in the base and extend upwardly out of direct contact with any part of the tank sidewall and have an upper end portion above the plane of the top of the sidewall. A fitting operatively engaged with the upper end portion of each tension rod bears effectively perpendicularly upon the top of the sidewall to pull on the tension rod and force the sidewall strongly toward the base. Provision is made for lateral motion of the lower portion of the sidewall relative to the tension rods which is necessary to minimize the effect of stresses resulting from wall curing, wall compression during horizontal post-tensioning, expansion and contraction.

19 Claims, 4 Drawing Figures

13b
24
26
25
12b
14
13
22
23
4
12
12a
19
13a
20
21
21a
11a
18
16
15
17
E
11

10
13
2
12
14
11
E 13
22
12
23

22
23
13
12

LIQUID STORAGE TANK

BACKGROUND OF THE INVENTION

Post-tensioned concrete tanks are well known in the art. Such tanks have a system of vertical and horizontal tendons which are tensioned after the concrete sidewall of a tank is cured, so as to place the concrete in compression. In some cases horizontal tendons are within the wall, while in other cases external tension bands gird the wall. In any such structure, the tendons within the wall must be sheathed so they are free to slide relative to the concrete when they are placed in tension. In a typical post-tensioned concrete tank the vertical tendons are anchored within the wall near its base and have a stressing element at the top of the wall.

Concrete tank walls used in the storage of liquid slurries such as manure are subjected to large forces due to hydrostatic pressure from the input pump and ice which may form in the tank. Vertical forces are created that actually tend to lift a wall off its foundation, thus permitting the contents of the tank to seep under the bottom of the sidewall where its freezing and thawing can damage both the sidewall and the foundation.

Post-tensioned concrete tank sidewalls of the prior art are typically from eight inches to twelve inches thick, and need conventional metal reinforcing rods set in the concrete.

SUMMARY OF THE INVENTION

In accordance with the present invention, conventional internal post-tensioning tendons are eliminated from a concrete tank sidewall; and instead a multiplicity of tension rods is anchored in the base upon which the concrete sidewall is seated. Each tension rod extends upwardly out of direct contact with any part of the sidewall and has an upper end portion adapted to receive a tension fitting. A tension fitting is operatively engaged with the upper end portion of each tension rod and bears effectively perpendicularly upon the sidewall to pull on the tension rod and force the sidewall strongly toward the base.

In the preferred form of the invention here disclosed, the tension rods extend vertically upwardly through the sidewall, and means surrounds each tension rod to isolate it from direct contact with the sidewall. The upper end portion of each tension rod extends above the plane of the top of the sidewall, and the tension fittings bear perpendicularly upon the top of the sidewall.

As is known in the prior art, a plurality of layers of sheet material are placed between the base and the bottom of the sidewall, and there is a compatible lubricant between the layers of sheet material. This permits radial motion of the bottom of the sidewall on the base to accommodate shrinkage of the sidewall during curing, compression of the sidewall during horizontal post-tensioning, and also thermal expansion and contraction of the sidewall. Such motion is critical to avoid damaging stresses in the vertical tension rods and the tank wall.

To accommodate the relative motion between the bottom of the sidewall and the base, the means that surrounds each tension rod includes a portion extending upwardly from the bottom of the sidewall which is constructed and arranged to allow slight lateral inward motion of the lower portion of the sidewall relative to the rod. This avoids undesirable stresses between the sidewall and the rod due to sidewall shrinkage during curing of the concrete and during horizontal post-tensioning.

The present structure permits considerably thinner tank sidewalls than have been possible with the prior art, and also eliminates the need for conventional reinforcing rods set in the concrete.

The structure also permits a tank to have an annular concrete base beneath the sidewall, with the floor of the tank being provided by a sheet of limp material which covers the entire area encompassed by the sidewall and has a peripheral portion in the lubricant sandwiched between the layers of sheet material under the sidewall. This provides a completely liquid-tight tank without the need for any special seals at the two faces of the bottom of the wall, and without the need for a water stop.

THE DRAWINGS

Figures 1, 2, 3, 4:
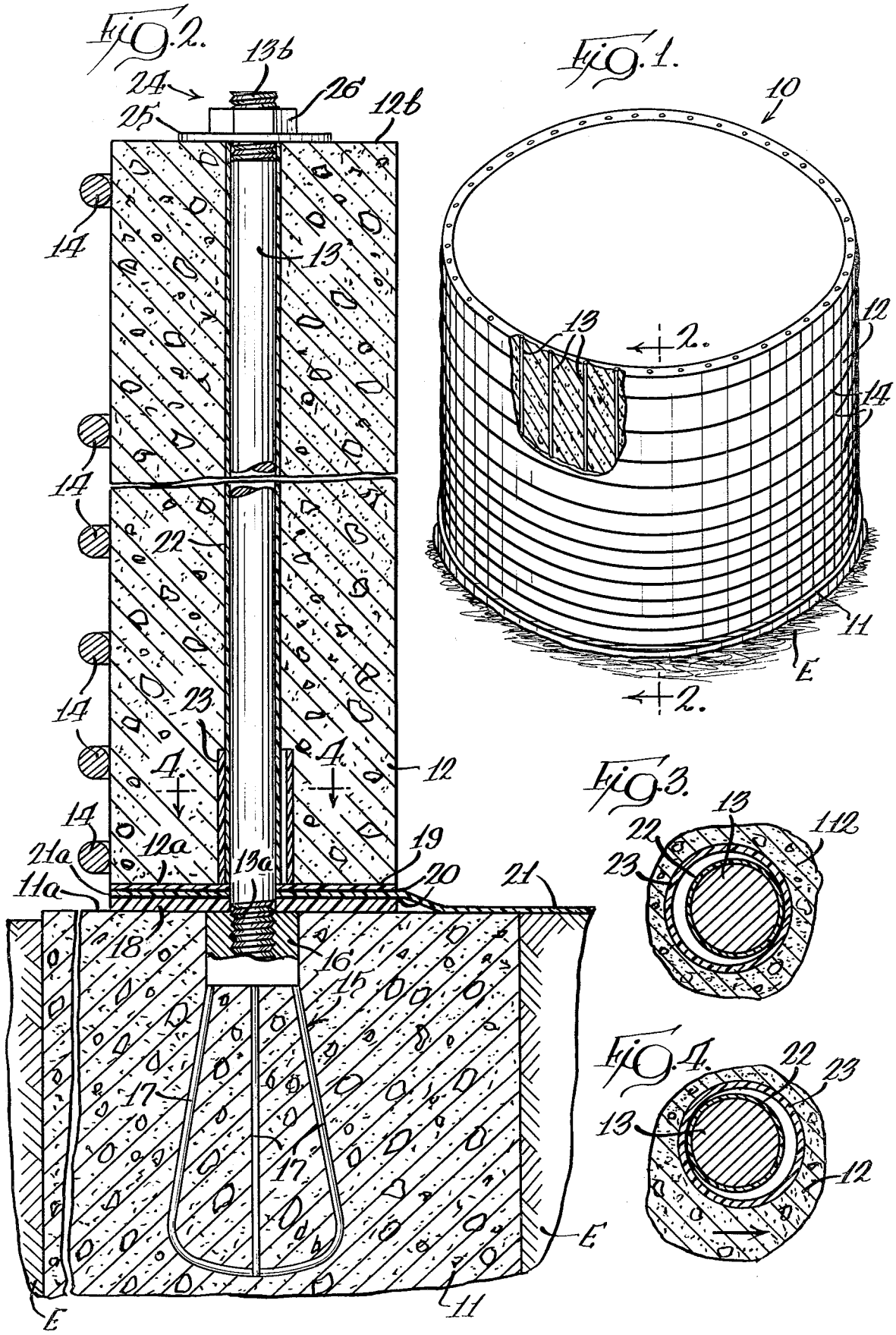
FIG. 1 is a perspective view of a tank embodying the invention with a part of the sidewall broken away to show the upright tension rods.
FIG. 2 is a fragmentary sectional view on an enlarged scale taken substantially as indicated along the line 2—2 of FIG. 1.

FIG. 3 is a fragmentary sectional view on an enlarged scale taken in the plane of the section line 4—4 to illustrate the relationship between a vertical tension rod and the lower end portion of the isolating means that surrounds the tension rod before the concrete has cured; and FIG. 4 is a fragmentary sectional view on an enlarged scale taken as indicated along the line 4—4 of FIG. 2 to show the relative positions of the tension rod and the lower end portion of the isolating means after the concrete is cured and post-tensioned horizontally.

DETAILED DESCRIPTION OF THE INVENTION

Referring to the drawings in detail, a concrete tank, indicated generally at 10, has an annular concrete base 11 set in the earth E, and an annular concrete sidewall 12 seated upon the base. Within the tank sidewall 12 is a multiplicity of upright tension rods 13 which are positioned approximately every three feet about the circumference of the sidewall which may be, typically, about 60 feet in diameter. A multiplicity of horizontal tension bands 14 gird the concrete sidewall 12 and are tensioned to put it in compression horizontally.

Referring now particularly to FIG. 2, an anchor, indicated generally at 15, is set in the sidewall and includes a threaded ferrule 16 the top surface of which is substantially flush with the top surface 11*a* of the base 11; and a plurality (typically four) of metal rods 17 are welded to the ferrule 16 and joined at their lower ends to form a cage-like structure which anchors the ferrule 16 firmly in the base 11.

Resting upon the top surface 11*a* of the base 11 is a bottom layer 18 of sheet material, and there is also an upper layer 19 of sheet material, and between the layers 18 and 19 is a compatible lubricant 20. In the embodiment of the invention illustrated in the drawings, a sheet 21 of limp material covers the entire area encompassed by the sidewall 12, and the entire periphery 21*a* of the sheet 21 is sandwiched between the layers 18 and 19 of sheet material in the compatible lubricant 20. Typically the bottom layer 18 may be a neoprene pad 3/16" thick, while the upper plastic sheet 19 may be polyethylene as little as 6 mils in thickness. The sheet 21 may also conveniently be polyethylene.

Each of the vertical tension rods 13 has a threaded lower end 13*a* which screws into the ferrule 16, and a threaded upper end portion 13*b* which, in the illustrated embodiment, extends above the plane of the top 12*b* of the sidewall. Isolating means 22 surrounds each tension rod 13 and has a portion 23 extending upwardly from the bottom 12*a* of the sidewall which is constructed and arranged to allow slight lateral inward motion of the lower portion of the sidewall relative to the rod.

Typically the rod 13 has a diameter of $\frac{3}{4}''$, the upper part 22 of the isolating means is a plastic pipe with a 13/16" inside diameter, and the lower portion 23 of the isolating means is a plastic pipe of 1" inside diameter.

When the tank is under construction, radial supports are provided to rest upon the two sides of an annular trench which is dug in the earth E, and the anchors 15 are hung from the radial supports so the concrete for the base 11 may be poured around them and through the cage-like structure of rods 17. Conveniently a bolt is screwed into the ferrule 16 to eliminate the possibility of concrete being poured into the threaded hole in the ferrule.

When the concrete of the base is cured, the neoprene pad 18 and the polyethylene sheet 19 with the layer of lubricant 20 between them are laid upon the top 11*a* of the base; and if the tank is to have no concrete floor, the limp sheet 21 is laid at that time with its peripheral portion 21*a* between the layers 18 and 19 of sheet material. If the tank is to have a complete concrete floor, of course, it may be poured at the same time as the base 11, and in that event no sheet 21 is required.

The tension rods 13 are then screwed into the ferrules 16, and temporary forms for pouring the concrete of the sidewall 12 are erected in the usual way, resting upon the base 11. Temporary supports engage the threaded upper end portions 13*b* of the tension rods 13 and are secured to the upper ends of the forms to hold the tension rods 13 perpendicular and spaced effectively midway between the inner and outer forms. As seen in FIG. 3, the lower portion 23 of each isolating means is radially outwardly eccentric with reference to the tension rod 13 surrounded by it, so that the fresh poured concrete 112 is held away from the rods 13 as seen in FIG. 3. As the concrete cures it shrinks radially, so the thin layer 19 of polyethylene slides slightly inwardly with reference to the neoprene pad 18 and the bottom sheet 21, and a lower portion 23 of the isolating means is moved from the position of FIG. 3 to the position of FIG. 4 by the shrinkage of the concrete during curing.

After the concrete is cured, the forms and the temporary holding means are removed, tension fittings 24 are operatively engaged with the upper end portion 13*b* of the tension rods 13 and the encircling tension hoops 14 are mounted. Conveniently, each of the tension fittings 24 consists of a large washer 25 and a threaded nut 26. The tension hoops 14 are pulled up to compress the concrete sidewall 12 horizontally, and the nuts 26 of the tension fittings 24 are screwed down under heavy pressure to force the sidewall 12 strongly toward the base 11.

The foregoing detailed description has been given for clearness of understanding only and no unnecessary limitations should be understood therefrom as modifications will be obvious to those skilled in the art.

We claim:

1. In a liquid storage tank of the type which has a base and an annular post-tensioned concrete sidewall seated on said base, the improvement comprising, in combination:

a multiplicity of tension rods anchored in the base, each of said tension rods extending upwardly out of direct contact with any part of the sidewall and having an upper end portion above the plane of the top of the sidewall adapted to receive a tension fitting;

and a tension fitting operatively engaged with the upper end portion of each tension rod and bearing effectively perpendicularly upon the top of the sidewall to post-tension the sidewall by pulling on the tension rod to force the sidewall strongly toward the base.

2. The combination of claim 1 in which the sidewall is free to shift laterally on the base, and a multiplicity of substantially horizontal tension hoops embraces said sidewall.

3. The combination of claim 1 or 2 in which the tension rods extend vertically upwardly through the sidewall, and means surrounds the entire length of each tension rod within the sidewall to isolate it from direct contact with the sidewall.

4. The combination of claim 3 in which the means that surrounds each tension rod includes a portion extending upwardly from the bottom of the sidewall which is constructed and arranged to allow slight lateral inward motion of the lower portion of the sidewall relative to the rod.

5. The combination of claim 4 in which said portion of the means surrounding each tension rod extends a short distance upwardly from the bottom of the sidewall, and above said portion said means functions only to isolate the tension rod.

6. The combination of claim 2 which includes two layers of sheet material between the base and the bottom of the wall, said layers sliding freely relative to one another.

7. The combination of claim 6 which includes a compatible lubricant between said layers of sheet material to assist said sliding movement.

8. The combination of claim 6 which includes a sheet of limp material at the bottom of the tank which covers the entire area encompassed by the sidewall, said sheet having a peripheral portion sandwiched between said two layers of sheet material.

9. In a liquid storage tank of the type which has a base and an annular concrete sidewall seated on said base, the improvement comprising, in combination:

a multiplicity of tension rods anchored in the base, each of said tension rods extending upwardly out of direct contact with any part of the sidewall and having an upper end portion adapted to receive a tension fitting;

a layer of sheet material between the base and the bottom of the wall;

and a tension fitting operatively engaged with the upper end portion of each tension rod and bearing effectively perpendicularly upon the sidewall to pull on the tension rod and force the sidewall into firm contact with said layer of sheet material to provide a liquid tight seal at the bottom of the sidewall.

10. The combination of claim 9 in which there are two layers of sheet material between the base and the bottom of the sidewall.

11. The combination of claim 10 which includes a compatible lubricant between said layers of sheet material to assist said sliding movement.

12. The combination of claim 9 which includes a sheet of limp material at the bottom of the tank which covers the entire area encompassed by the sidewall, said sheet having a peripheral portion sandwiched between said two layers of sheet material.

13. The combination of claim 9 in which the upper end portion of each tension rod is above the plane of the top of the sidewall, and the tension fitting bears upon the top of the sidewall.

14. The combination of claim 13 in which the tension rods extend vertically upwardly through the sidewall, and means surrounds each tension rod to isolate it from direct contact with the sidewall.

15. In a liquid storage tank of the type which has a base and an annular concrete sidewall seated on said base, the improvement comprising, in combination:

a multiplicity of tension rods anchored in the base, each of said tension rods extending upwardly out of direct contact with any part of the sidewall and having an upper end portion adapted to receive a tension fitting;

a sheet of limp material at the bottom of the tank which covers the entire area encompassed by the sidewall and has a peripheral portion sandwiched between the base and the bottom of the wall;

and a tension fitting operatively engaged with the upper end portion of each tension rod and bearing effectively perpendicularly upon the sidewall to pull on the tension rod and force the sidewall into firm contact with said sheet of limp material to provide a liquid tight seal at the bottom of the sidewall.

16. The combination of claim 15 which includes a layer of sheet material between the base and the bottom of the wall in surface contact with said peripheral portion of the sheet of limp material.

17. The combination of claim 16 which includes a compatible lubricant between said layer of sheet material and said sheet of limp material.

18. The combination of claim 15 in which the upper end portion of each tension rod is above the plane of the top of the sidewall, and the tension fitting bears upon the top of the sidewall.

19. The combination of claim 15 in which the tension rods extend vertically upwardly through the sidewall, and means surrounds each tension rod to isolate it from direct contact with the sidewall.

* * * * *